United States Patent [19]

Braga et al.

[11] 4,135,258

[45] Jan. 23, 1979

[54] WASTE DISPOSER MOUNTING APPARATUS

[75] Inventors: Albert T. Braga, Stevensville; Robert A. Brenner, St. Joseph; Victor W. Cuthbert, Sodus, all of Mich.

[73] Assignee: Whirlpool Corporation, Benton Harbor, Mich.

[21] Appl. No.: 781,010

[22] Filed: Mar. 24, 1977

[51] Int. Cl.[2] ..... B02C 18/42; F16L 19/03

[52] U.S. Cl. ..... 4/187 A; 4/DIG. 4; 241/46 A; 241/100.5; 285/159; 285/197; 285/360

[58] Field of Search ..... 4/187A, 191, 286, DIG. 4; 241/46 A, 257 G, 100.5, 285 R; 285/159, 192, 197–199, 360; 220/300, 301

[56] References Cited

U.S. PATENT DOCUMENTS

| | | | |
|---|---|---|---|
| 1,029,404 | 6/1912 | Schumacher | 285/360 |
| 1,542,703 | 6/1925 | Kirkman | 285/360 X |
| 2,710,010 | 8/1939 | Conner | 285/360 X |
| 2,939,639 | 6/1960 | Coss | 241/100.5 |
| 3,089,654 | 5/1963 | Voudy | 241/100.5 |
| 3,481,310 | 12/1969 | Alburger | 285/192 X |
| 3,695,519 | 10/1972 | Bebinger | 241/100.5 X |
| 3,746,370 | 7/1973 | Aulisa | 285/197 X |
| 3,768,742 | 10/1973 | Preher et al. | 241/100.5 |
| 3,913,783 | 10/1975 | Cooper | 220/301 X |

*Primary Examiner*—Stuart S. Levy

*Attorney, Agent, or Firm*—Wegner, Stellman, McCord, Wiles & Wood

[57] ABSTRACT

Mounting apparatus for installing a food waste disposer in a sink in a bottom opening thereof wherein the disposer is moved downwardly through the opening and is clamped to the sink about the edge of the opening. A water inlet connector is mounted to the disposer subjacent the sink and a waste discharge conduit is mounted to the disposer below the water inlet connection. An improved clamp ring and locking ring structure are provided for effecting the clamping of the disposer to the sink opening edge. The water inlet connector is installed by movement downwardly through the upper end of the disposer and subsequently urging it outwardly through a horizontal opening of the disposer. The water discharge conduit includes a tubular element secured to the disposer by a strap clamp encircling the disposer.

14 Claims, 10 Drawing Figures

38
42
37
39
20
40
41
19
13
45
43
47
36
56
52
55
53
58
57
59
31
23
22
32
32
32
33
25
34
34
30
35
33
33
29

11
12
3.
3.
1
10

20
15
13
35
27
30
23
24
16
33
28
22
29
21
34
25
26
5.
6.
4.
42
39
101
19
38
37
36
60
48
49
43
59
52
46
45
50
7.
47
44
58
53
51

Fig. 7.
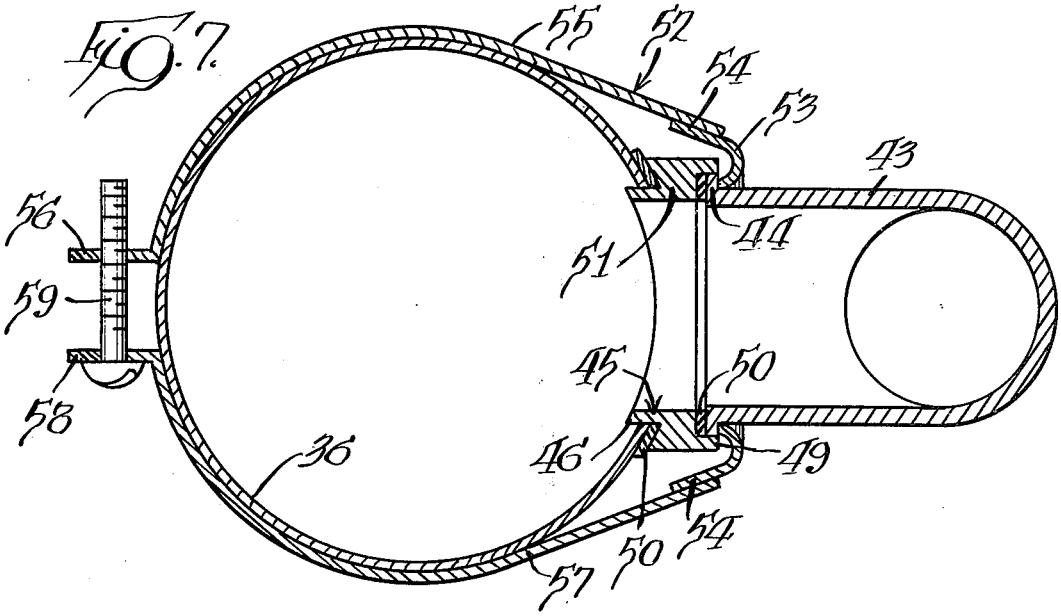
Fig. 9.
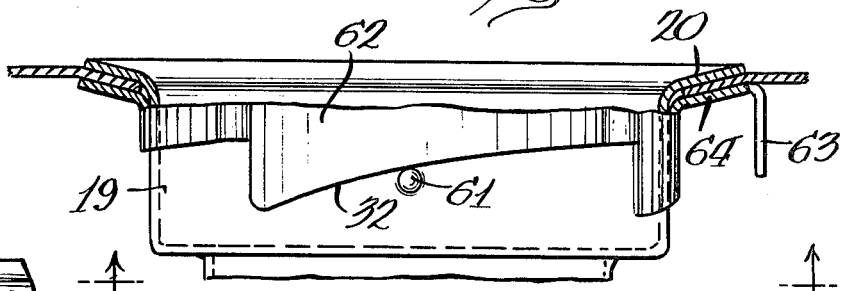
Fig. 8.
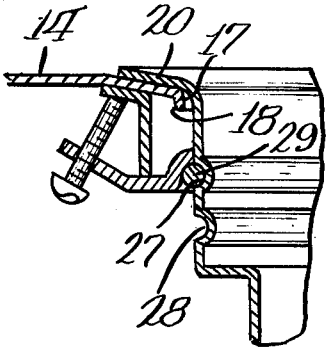
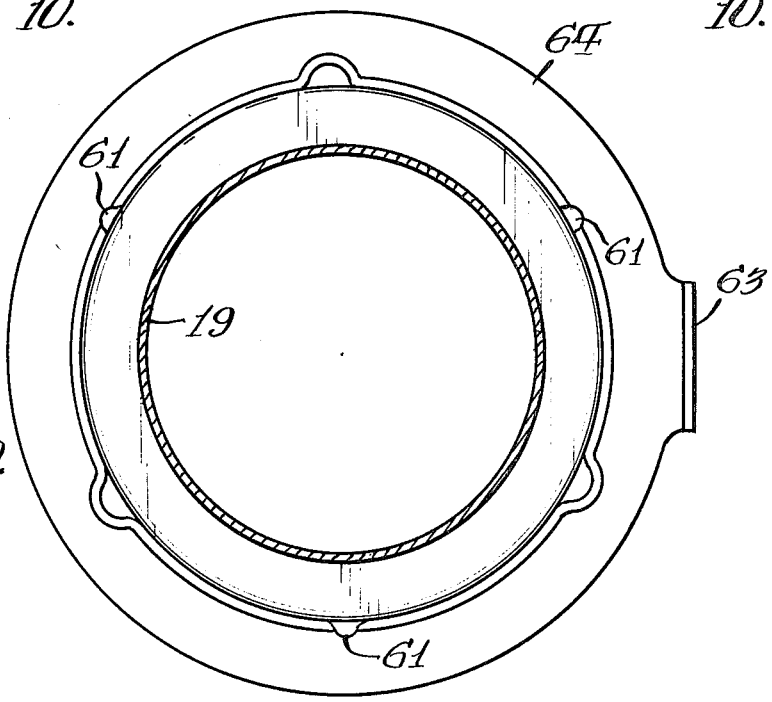
Fig. 10.

WASTE DISPOSER MOUNTING APPARATUS

BACKGROUND OF THE INVENTION

1. Field of the Invention

This invention relates to food waste disposers and in particular to the mounting of food waste disposers in kitchen sinks and the like.

2. Description of the Prior Art

In U.S. Pat. No. 2,788,541 of Warren N. Kemnitz, a floor attachment for a vacuum cleaner is shown to include a tubular outlet secured around the body of the vacuum cleaner by a strap and buckle means.

In French Pat. No. 1,250,604 of M. Wambergue, a sewer evacuation device is shown for comminuting sewage such as delivered to a toilet bowl. The device is adapted to be mounted to the bowl by an overlying flange and underlying clamp ring with a resilient gasket being disposed between the flange and toilet bowl. A waste discharge conduit is connected to the body of the device by a threaded ring and sealing plastic ring.

In U.S. Pat. No. 2,922,526 of William Ohmann, a drain funnel is disclosed wherein the funnel is mounted to a lower end of a washing machine tub by means of an enlarged upper flange and cooperating locking ring engaging the underside of the tub.

George R. Coss, in U.S. Pat. No. 2,939,639, shows a food waste disposer adapted to be mounted to a securing ring previously secured to the sink.

Arthur A. Voudy, in U.S. Pat. No. 3,089,654, shows a sink outlet connection having a connector clamped to the sink outlet opening edge portion.

In U.S. Pat. No. 3,393,021, Lauren W. Guth shows a bearing unit for mounting a food waste disposer in hanging relationship to a downwardly projecting outlet portion of the sink.

In U.S. Pat. No. 3,687,490, Paul G. Dunmire shows a pipe saddle having a flexible strap adapted to be disposed about a pipe into which a branch line is connected.

Robert F. Phillips, in U.S. Pat. No. 3,694,009 shows a pipe saddle for attaching service lines to larger diameter pipelines, the saddle being defined by a strap clamped about the pipeline and having an opening for accommodating a standard corporation stop valve.

In U.S. Pat. No. 3,734,416, Lauren W. Guth shows a sink mount support assembly for mounting a disposer to a sink drain sleeve defining the bottom discharge opening of the sink.

U.S. Pat. Nos. 3,768,742 of John L. Preher et al, and 3,797,764 and 3,827,730 of Lauren W. Guth, disclose a sink mount support assembly generally similar to that of the Guth 3,734,416 assembly.

SUMMARY OF THE INVENTION

The present invention comprehends an improved method of installing a food waste disposer in a sink in a bottom opening thereof and improved mounting means for effecting such installation.

More specifically, the method of installing the food waste disposer includes the steps of moving the disposer downwardly through the opening in the bottom wall of a sink to cause an outturned top flange of the disposer to set on the sink at the edge of the outlet opening. Clamp means are then moved upwardly about the disposer to mount on the disposer subjacent the sink and means are provided for manipulating the clamp means to cooperate with the disposer flange to secure the disposer to the sink against vertical movement in the outlet opening. A water inlet connector to which a dishwasher drain conduit is connected may be mounted to an upper portion of the disposer to extend outwardly therefrom subjacent the sink and a waste discharge conduit is mounted to the disposer below the water inlet connector.

Thus, the invention comprehends installing a compact disposer having a diameter preselected to permit dropping of the disposer through the sink opening so as to hang from the sink on an annular top flange of the disposer. Securing of the disposer to the sink is then facilitated by clamping of the flange downwardly to the sink by means installed from below the sink.

In one form, the clamp ring engages protrusions on the disposer body so as to be cammed upwardly as a result of rotation of the clamp ring coaxially about the disposer in engagement with the protrusions.

In another form, the disposer is provided with one or more annular grooves in a top portion thereof adapted to selectively receive a snap ring for cooperation with a locking ring and cam ring in effecting a camming-type clamping of the disposer flange to the sink.

Upon securing of the disposer to the sink, a water inlet connector may be installed by movement downwardly through the upper portion of the disposer and subsequently outwardly through a horizontal opening in an upper portion of the disposer. The connector may include suitable locking means for locking the connector to the disposer body in the outwardly projecting arrangement.

A waste discharge conduit is secured to the disposer subjacent the water inlet connector by means of a strap adapted to be clamped about the disposer body and provided with a mounting portion adapted to engage a flange on the waste discharge conduit for drawing the conduit flange tightly to the disposer body in the installed arrangement.

Thus, the invention comprehends an extremely simple and economical method of installing a food waste disposer to a sink and includes structure for effecting the same which is extremely simple and economical while yet providing the above discussed advantages.

BRIEF DESCRIPTION OF THE DRAWING

Other features and advantages of the invention will be apparent from the following description taken in connection with the accompanying drawing wherein:

FIG. 7 is a horizontal section taken substantially along the line 7—7 of FIG. 3;

FIG. 8 is a fragmentary enlarged vertical section illustrating a modified mounting of the disposer relative to a sink having a thin wall;

FIG. 9 is a fragmentary vertical section illustrating a modified form of clamping of the disposer to the sink; and FIG. 10 is a horizontal section taken substantially along the line 10—10 of FIG. 9.

DESCRIPTION OF THE PREFERRED EMBODIMENTS

Figures 1, 2:
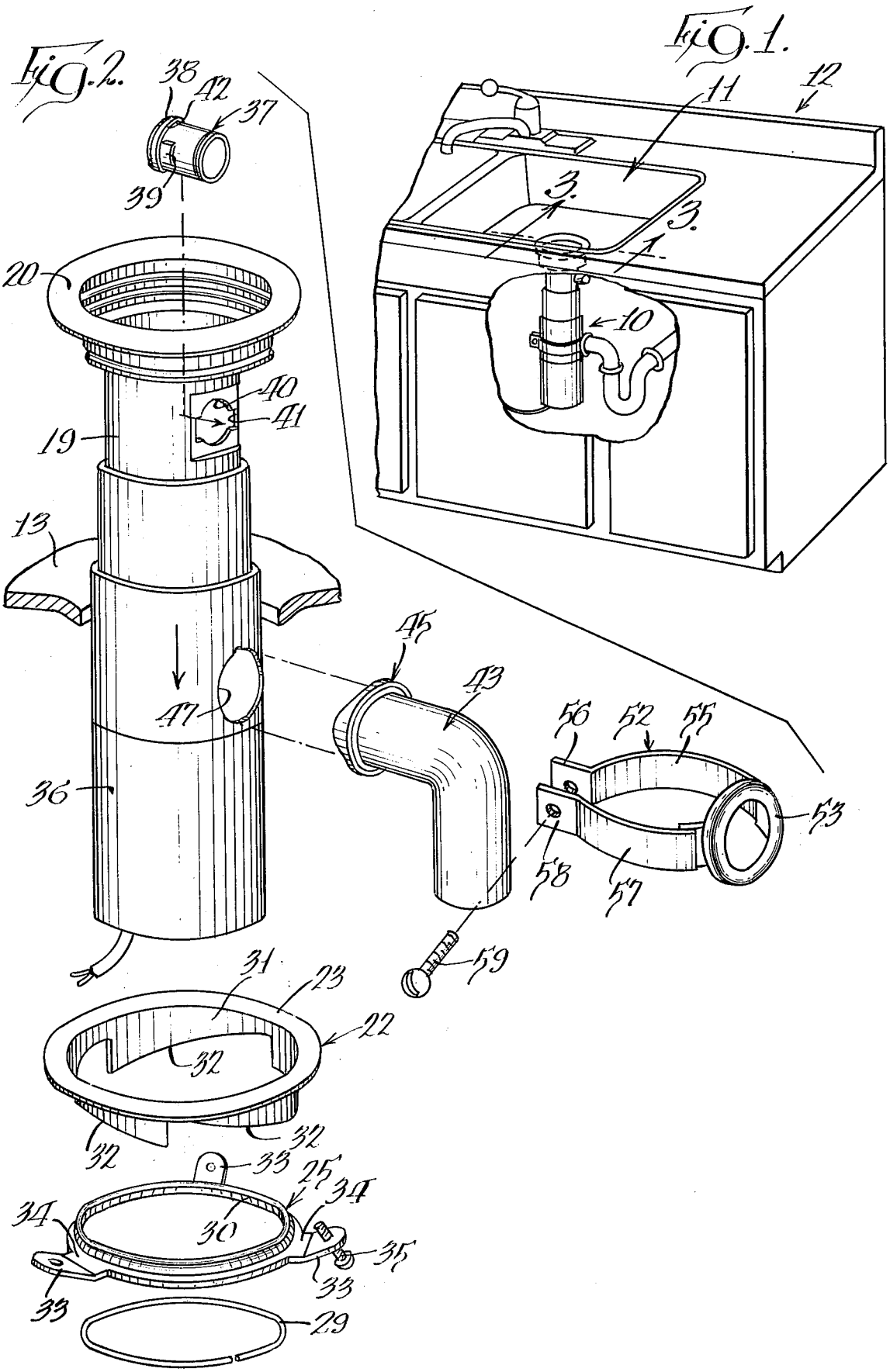
FIG. 1 is a perspective view of a sink having a food waste disposer installed therein in accordance with the invention.
FIG. 2 is an exploded view illustrating the installation of the food waste disposer and associated mounting means.
Figures 3, 4, 5, 6:
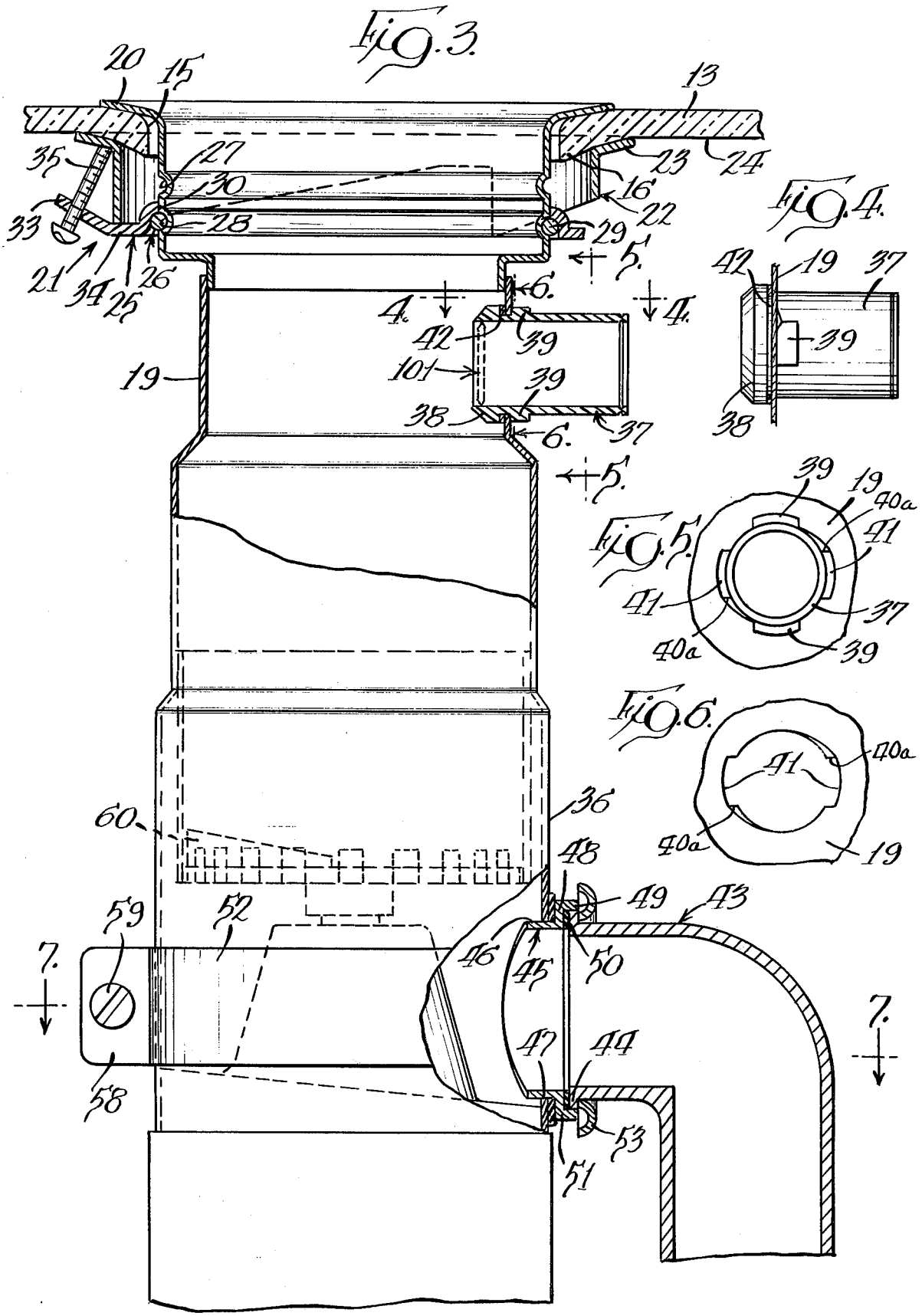
FIG. 3 is a vertical section of the installed assembly.
FIG. 4 is a horizontal section taken substantially along the line 4—4 of a portion of FIG. 3.
FIG. 5 is a fragmentary vertical section taken substantially along the line 5—5 of FIG. 3.
FIG. 6 is a fragmentary vertical section taken substantially along the line 6—6 of FIG. 3.

In the exemplary embodiment of the invention as disclosed in the drawing, a food waste disposer generally designated 10 is installed in a kitchen sink generally designated 11 which may, in turn, be mounted in a conventional floor-mounted cabinet 12, as shown in FIG. 1. The sink may have a conventional relatively thick bottom wall 13, as shown in FIG. 3, or alternatively, may have a relatively thin bottom wall 14, as shown in FIG. 8. As further shown in FIG. 3, the sink bottom wall 13 may be provided with a drain opening 15 defined by a downturned annular flange 16, and as shown in FIG. 8, sink bottom wall 14 may be provided with a drain opening 17 defined by a downturned flange 18.

The present invention comprehends the installation of the food waste disposer in the sink by a novel method wherein the disposer is brought downwardly through the sink opening. As shown in FIG. 2, the disposer includes an upper portion 19 terminating in an annular outturned top flange 20. As shown in FIG. 3, the top flange 20 rests on the sink bottom at the edge of opening 15 when the disposer is fully inserted into the sink.

To secure the disposer in the installed position, clamping means generally designated 21 are provided, as best seen in FIG. 3. The clamping means herein include a cam or clamp ring 22 having an upper outturned annular flange 23 adapted to engage the underside surface 24 of the sink wall 13. The camming means, in turn, may be urged upwardly against the wall surface 24 by coaction with a locking ring 25 and shoulder means generally designated 26.

As shown in FIG. 3, the disposer upper portion 19 defines a pair of annular grooves 27 and 28 disposed below the lower level of flange 16 when the disposer flange 20 is set on the wall 13.

Shoulder means 26 further includes a snap ring 29 which, when installed selectively in either of grooves 27 or 28, defines an outwardly extending annular shoulder against which an inner edge portion 30 of the locking ring is abutted for drawing the disposer downwardly as a result of the camming action of cam ring 22, thereby to correspondingly urge the flange 20 securely against sink wall 13 about opening 15.

As best seen in FIG. 2, cam ring 22 includes a tubular wall portion 31 extending downwardly from flange 23 and defining, on its lower edge, a plurality of cam surfaces 32 circumferentially spaced about the axis of the ring. The locking ring 25 includes a plurality of ears 33 correspondingly spaced about the axis of the locking ring and having inner cam follower portions 34 adapted to engage the camming surfaces 32.

To effect the desired mounting of the disposer to the sink, as shown in FIG. 3, the locking ring is rotated about the axis of the disposer with the edge portion 30 bearing against the stop shoulder defined by snap ring 29 in the selected groove. Such rotation causes the follower portions 34 to move along the cam surfaces 32 suitably to provide a reaction wherein the cam ring is urged upwardly and the disposer body portion 19 is urged downwardly thereby to clamp the sink wall 13 between the flanges 20 and 23 and secure the disposer against vertical movement in the sink opening.

Upon securing of the disposer thusly, the adjusted position of the locking ring may be secured by suitably threading a plurality of screws 35 through the ears 33 into engagement with the cam ring flange 23.

The food waste disposer is thusly firmly secured to the sink by the improved facilitated installation method discussed above which requires a simple rotation of the locking ring and securing of the adjusted positioning of the locking ring by simple threading of the screws 35 to complete the mounting.

As discussed above, in installing the disposer, the disposer body is firstly moved downwardly through the sink opening. To this end, the disposer body has a maximum diameter less than the diameter of the sink opening 15, and more specifically, the disposer includes a lower body portion 36 having a diameter smaller than the diameter of the sink opening. To facilitate connections of a dishwasher drain outlet and a waste discharge line to the disposer, further improved installation structure is provided within the scope of the invention which, in the installed arrangement, may project substantially outwardly from the disposer body portions 19 and 20, respectively.

More specifically, as shown in FIGS. 2 and 3, the water inlet connector 37 comprises a tubular element having an annular flange 38 at its inner end and a pair of diametrically opposed locking lugs 39. The disposer body portion 19 is provided with a keyhole opening 40 having diametrically opposed rectangular recesses 41 adapted to pass the locking lugs 39 when the water inlet connector 37 is brought downwardly into the body portion 19 and then outwardly through the opening 40, as shown by the arrows in FIG. 2. With the connector thusly extended through the opening 40, the connector is then rotated to move the lugs 39 into overlying relationship with the disposer wall, as shown in FIG. 3, to secure the water inlet connector 37 to the disposer body for suitable connection of a dishwasher drain conduit (not shown). The disposer wall may be provided with raised points 40*a* for preventing overtravel of the connector in installation. A clamp, or other suitable fastener means may be used in securing the connection between the water inlet connector 37 and the dishwasher drain conduit, and liquid discharged from the dishwasher will then be introduced into the disposer chamber through the opening 40 for discharge from the disposer through a horizontal opening 47 to the household drain. Of course, if it is not necessary to accommodate a dishwasher drain outlet, the water inlet connector may be omitted or a plug may be inserted into the opening 40. In one form of the invention, the water inlet connector 37 may have a thin membrane 101 (see FIG. 3) molded across its opening. This membrane is removed by breaking it out when a dishwasher drain connection is to be made, or may be left intact where no such connection is desired.

As shown in FIG. 3, the connector 37 may be provided with a sealing ring 42 adapted to be clamped between flange 38 and the body wall when the connector is secured to the wall, as discussed above. The sealing ring further biases the connector axially inwardly so as to frictionally retain the lugs 39 against movement along the disposer wall surface to retain the connector in locked association with the disposer.

Referring to FIGS. 2 and 3, a waste discharge conduit, or tailpiece, generally designated 43 is also connected to the disposer, and more specifically, to the lower portion 36 of the disposer. The conduit 43 includes an outturned flange 44 at its inner end. A plastic adapter collar 45 is provided with an inner tubular portion 46 received in the opening 47 of the disposer. The adapter collar further includes a radially outturned mid-portion 48 and an axially outturned distal portion 49. A first annular gasket 50 is disposed between the tailpiece flange 44 and adapter mid-portion 48 and a second annular gasket 51 is disposed between adapter mid-porton 48 and the wall of disposer portion 36.

The tailpiece 43 is secured in sealed association with the disposer portion 36 by means of a strap clamp generally designated 52. As best seen in FIGS. 2 and 7, the clamp 52 includes an annular pressure ring 53 having a pair of diametrically opposed, outwardly projecting connecting portions 54. The clamp includes a first strap 55 extending from connecting portion 54 to a turned distal end 56. The clamp includes a second strap 57 extending from the opposite connecting portion 54 to a turned distal end 58 facially juxtaposed to end 56 and threadedly connected thereto by a screw 59 for tightly drawing the clamp about the disposer body portion 36.

As best seen in FIG. 2, the opening 47 may be vertically aligned with opening 40 for facilitated installation of the water inlet and waste discharge means. The opening 47 is disposed subjacent the comminuting means 60 of the disposer schematically illustrated in FIG. 3 for discharging the effluent subsequent to the comminuting operation.

As indicated briefly above, the invention contemplates utilizing either of the grooves 27 or 28 in effecting the installation depending on the thickness of the sink bottom wall. Thus, as shown in FIG. 8, the snap ring 29 may be installed in the upper groove 27 where the sink wall 14 is a thin wall to provide a clamping of the disposer flange 20 to the sink wall substantially in the same manner as relative to the thick wall, as illustrated in FIG. 3.

In the embodiment of the invention disclosed in FIGS. 9 and 10, the shoulder means provided on the disposer are illustrated as comprising integral protrusions 61 adapted to be engaged by the camming surfaces 32 as the camming ring 62 is rotated coaxially about the disposer portion 19 by means of a downturned handle portion 63 projecting downwardly from flange 64 of camming ring 62.

Thus, in the embodiment of FIG. 9, the camming operation is effected by rotation of the camming ring with the camming surfaces 32 bearing directly against the shoulder means or projections carried by the disposer, the locking ring being omitted in the arrangement. The locking of the camming ring in the adjusted position may be effected by the frictional facial engagement between the camming ring flange 64 and the sink flange 20.

By means of the present invention, the installation of the disposer is facilitated and simplified. It is unnecessary to support the disposer from below the sink during the installation as is required in the conventional prior art devices wherein the disposer is mounted to a previously installed sink drain opening flange. The disposer is supported by its own top flange once it is lowered through the sink opening and all undercounter operations may be readily and simply effected relative to the thusly supported disposer. The use of threaded and rotative camming means permits the installation with standard simple tools and permits the installation to be rapidly and securely made.

The foregoing disclosure of specific embodiments is illustrative of the broad inventive concepts comprehended by the invention.

We claim:

1. In a food waste disposer having an outturned top flange and lower body, improved securing means for securing the disposer to a sink in a bottom opening thereof with the disposer flange resting on the sink at the edge of said opening and with the disposer body extending downwardly therefrom through said opening, said securing means comprising:

a clamp ring adapted to be disposed about said body, said clamp ring having an upper portion adapted to engage the underside of the sink at the edge of said opening, and a lower portion defining a plurality of circumferentially related downwardly facing continuously inclined cam surfaces;

outwardly projecting shoulder means on said disposer body, said cam inclined surfaces engaging said shoulder means and urging said upper portion of the clamp ring upwardly to a clamping position as an incident of relative coaxial rotation of the clamp ring and shoulder means, whereby said clamp ring upper portion may cooperate with the disposer flange in infinitely adjustably clamping the disposer to the sink; and means for locking the clamp ring in said adjustable clamping position.

2. The food waste disposer securing structure of claim 1 wherein said shoulder means is integral with said disposer body.

3. The food waste disposer securing structure of claim 1 wherein said shoulder means comprises means removably secured to said disposer body.

4. The food waste disposer securing structure of claim 1 wherein said shoulder means comprises a plurality of protrusions on said disposer body.

5. The food waste disposer securing structure of claim 1 wherein said shoulder means includes an annular groove in said disposer body, a snap ring in said groove, and means abutting said snap ring and defining cam follower means for slidably engaging said cam surface to urge said clamp ring axially as an incident of relative rotation between said cam surface and said cam follower means.

6. The food waste disposer securing structure of claim 1 wherein said shoulder means includes an annular groove in said disposer body, a snap ring in said groove, and a locking ring rotatable coaxially about said disposer slidably against said snap ring and defining a cam follower surface upwardly engaging said cam surface to urge said clamp ring axially as an incident of rotation of said locking ring.

7. The food waste disposer securing structure of claim 1 wherein said shoulder means includes an annular groove in said disposer body, a snap ring in said groove, and a locking ring rotatable coaxially about said disposer slidably against said snap ring and defining a cam follower surface upwardly engaging said cam surface to urge said clamp ring axially as an incident of rotation of said locking ring, said clamp ring lower portion further defining at least one additional circumferentially spaced such cam surface, and said locking ring further defining a corresponding plurality of such cam follower surfaces associated one each with said cam surfaces for providing a distributed clamping force for securing the disposer to the sink.

8. The food waste disposer securing structure of Claim 1 wherein said disposer body defines a plurality of axially spaced mounting portions and said shoulder means is selectively mounted to any one of said mounting portions for selective adjustability in the urging of the cam means upwardly as an incident of said relative rotation.

9. The food waste disposer securing structure of claim 8 wherein said mounting portions comprise a plurality of axially spaced annular grooves on said disposer body, said shoulder means being selectively installed in any one of said grooves for causing said selective adjustability of the urging of the cam means upwardly as an incident of said relative rotation.

10. In a food waste disposer having an outturned top flange and a lower body, improved means for installing the disposer to a sink in a bottom opening thereof with the disposer flange resting on the sink at the edge of said opening and with the disposer body extending downwardly therefrom through said opening, said installing means comprising:

a clamp ring adapted to be disposed about said body, said clamp ring having an upper portion adapted to engage the underside of the sink at the edge of said opening, and a lower portion defining a plurality of circumferentially related downwardly facing continuously inclined cam surfaces;

outwardly projecting shoulder means on said disposer body, said cam inclined surfaces engaging said shoulder means and urging said upper portion of the clamp ring upwardly to a clamping position as an incident of relative coaxial rotation of the clamp ring and shoulder means, whereby said clamp ring upper portion may cooperate with the disposer flange in infinitely adjustably clamping the disposer to the sink;

means for locking the clamp ring in said adjustable clamping position;

a water inlet connector removably mounted to said body subjacent said shoulder means; and a waste discharge connector removably mounted to said body below said water inlet connector.

11. The food waste disposer installing means of claim 10 wherein said disposer defines an upper open throat portion adapted to pass said connector downwardly therethrough for extension thereof outwardly through said body subsequent to the extension of said body downwardly through said sink opening.

12. The food waste disposer installing means of claim 10 wherein said waste discharge connector includes a tubular element having an annular connector portion extending through said disposer body, collar means on said connector portion, and clamp means encircling said disposer and clamping said collar means to said disposer body for removably securing said connector to said disposer body.

13. In a food waste disposer having an outturned top flange and lower body, improved securing means for securing the disposer to a sink in a bottom opening thereof with the disposer flange resting on the sink at the edge of said opening and with the disposer body extending downwardly therefrom through said opening, said securing means comprising:

a clamp ring adapted to be disposed about said body, said clamp ring having an upper portion adapted to engage the underside of the sink at the edge of said opening, and a lower portion defining a plurality of circumferentially related downwardly facing continuously inclined cam surfaces;

outwardly projecting shoulder means on said disposer body, said cam inclined surface engaging said shoulder means and urging said upper portion of the clamp ring upwardly to a clamping position as an incident of relative coaxial rotation of the clamp ring and shoulder means, whereby said clamp ring upper portion may cooperate with the disposer flange in infinitely adjustably clamping the disposer to the sink;

means for locking the clamp ring in said adjustable clamping position; and a water inlet connector comprising a tubular member having an annular flange end within said body, a tubular portion extending outwardly through said body, and shoulder means on said tubular portion cooperating with said annular flange for removably locking said connector to said body.

14. The food waste disposer securing structure of claim 13 further including annular sealing means abutting said annular flange and said body for sealing said connector to said body and biasing said shoulder means into frictionally retained association with said body.

* * * * *